US006644543B2

(12) United States Patent
Cox et al.

(10) Patent No.: US 6,644,543 B2
(45) Date of Patent: Nov. 11, 2003

(54) ENHANCED-SECURITY DELIVERY RECEPTACLES WITH BRICK-IN FEATURE

(76) Inventors: Bobbie J. Cox, 4620 Royal La., Dallas, TX (US) 75229; Charles W. Langley, 7940 Walnut Dr., Alvarado, TX (US) 76009; David E. Rankin, 3928 Wosley, Fort Worth, TX (US) 76133; David S. Wick, 720 Tanglewood Dr., Hurst, TX (US) 76053; Oscar P. Roper, 4749 Kilpatrick, Fort Worth, TX (US) 76107; Dale R. Westerfield, 5307 Hidden Trails Dr., Arlington, TX (US) 76017

( * ) Notice: Subject to any disclaimer, the term of this patent is extended or adjusted under 35 U.S.C. 154(b) by 0 days.

(21) Appl. No.: 10/065,412

(22) Filed: Oct. 16, 2002

(65) Prior Publication Data

US 2003/0019921 A1 Jan. 30, 2003

Related U.S. Application Data

(62) Division of application No. 09/727,005, filed on Nov. 30, 2000.

(51) Int. Cl.[7] ..... B65G 11/04
(52) U.S. Cl. ..... 232/47; 232/38
(58) Field of Search ..... 232/47, 431, 17, 232/38, 45

(56) References Cited

U.S. PATENT DOCUMENTS

| | | | | | |
|---|---|---|---|---|---|
| 1,480,452 | A | * | 1/1924 | Kolstad | 232/17 |
| 3,880,344 | A | * | 4/1975 | Earle | 232/17 |
| 4,753,386 | A | * | 6/1988 | Phillion, Sr. | 232/43.1 |
| 4,793,551 | A | * | 12/1988 | Baylor | 232/17 |
| 5,148,974 | A | * | 9/1992 | Clapper | 232/17 |
| D337,415 | S | * | 7/1993 | McDowell | D99/29 |
| 5,351,883 | A | * | 10/1994 | Pachl | 232/17 |
| 5,435,484 | A | * | 7/1995 | Carlson | 232/47 |
| D398,134 | S | * | 9/1998 | Taylor | D99/29 |
| 5,938,113 | A | * | 8/1999 | Kim | 232/47 |
| 6,109,519 | A | * | 8/2000 | McClure | 232/17 |
| 6,244,505 | B1 | * | 6/2001 | Grimes et al. | 232/47 |
| 6,247,642 | B1 | * | 6/2001 | Wilson, Jr. | 232/47 |

* cited by examiner

*Primary Examiner*—William Miller
(74) *Attorney, Agent, or Firm*—Daniel V. Thompson

(57) ABSTRACT

A delivery receptacle has an upper compartment having a greater depth dimension than the lower compartment, with back walls of the upper and lower compartments being substantially aligned, such that the upper compartment has an extended front section with respect to a front wall of the lower compartment to permit a bricked-in installation of the receptacle.

1 Claim, 16 Drawing Sheets

ENHANCED-SECURITY DELIVERY RECEPTACLES WITH BRICK-IN FEATURE

CROSS REFERENCE TO RELATED APPLICATIONS

This is a divisional application based on application Ser. No. 09/727,005 filed Nov. 30, 2000.

BACKGROUND OF INVENTION

The present invention relates to delivery receptacles, and more particularly to delivery receptacles having enhanced security.

Receptacles, such as mailboxes and other depositories for various items, have been in use for many years. Typically a mailbox is located along a roadway or in the wall of a home for delivery and pickup of mail. Typical conventional mailboxes that are readily accessible to authorized delivery and pickup persons are also generally accessible to unauthorized persons. Therefore, such conventional mailboxes leave a person's mail and packages susceptible to theft, vandalism, and lack of privacy. With the increased popularity of "e-commerce" and the associated common carrier delivery of purchased items as packages, the need for enhanced security of delivery receptacles has become acute.

Also, when someone is away from home for several days or weeks, mail that is continually delivered on a daily basis accumulates in the person's mailbox. The accumulated mail not only jams conventional mailboxes, but also can provide a signal to burglars and vandals that the person is away from home for an extended period, thus marking the person's home as an easy target for a burglary or vandalism. While the person can request Post Office personnel to withhold mail delivery or ask a neighbor to collect his mail during his absence, there are times when these solutions are impractical. For example, the person might leave on short notice or forget to make arrangements with the Post Office or a neighbor until the last minute before leaving, when it might be after hours or too late or too inconvenient to make such arrangements. Also, such arrangements themselves can be a means of disseminating the information that the person is planning to be gone and the length of his absence, which information, through careless or unscrupulous postal employees or neighbors, can get to burglars or vandals. It is often more desirable, therefore, to simply say nothing and allow mail, newspapers, and the like to accumulate during a short absence. In such situations, a mailbox having a locked, high-volume storage compartment for mail to accumulate would be desirable. It would also be desirable to have the mail accumulate out of sight so that a potential burglar could not see the mail accumulation. Yet, when the person is home, he might prefer a normal mailbox for sending and receiving his mail. Thus, there is a need for a delivery receptacle that is easily convertible between normal and high-volume configurations.

A number of mailboxes have been made to provide security for the deposited items by having the items pass through a trap mechanism into a security area when the door is closed, so that the items cannot be returned through the trap mechanism when the door is opened. Such arrangements have excessive mechanical parts that wear and break or are affected by moisture, ice, or snow, and have been relatively expensive to manufacture and unreliable in use, thus limiting their successful uses by typical consumers. Some attempts using trap mechanisms have provided mechanisms attached to the flag to deflect the operation of the trap when mail was to be picked up by the postman, resulting in additional manufacturing costs. Many times the postman would first lower the flag and unknowingly deposit the mail to be picked up into the secured compartment. Also, many of the prior attempts only had small storage spaces with no provision for holding accumulated mail in a secured chamber while in the absence of the patron. Also prior attempts made no adequate or easily operable provision to allow the optional use of the device as an ordinary unsecured mailbox with a selectable alternate use for secured long-term retainment and storage of delivered items.

In summary, while there have been a number of prior attempts to solve the problems of providing a secure storage of mail or other items, there is still a substantial, unfulfilled need for an improved mailbox that is simple to operate, economical to produce, easy to gain access and pick up mail on a stationary shelf in normal configuration, optionally convertible to secured, high-volume configuration prevent theft, and has a large enough compartment for adequate storage of items accumulated out of sight for at least several days or weeks until they are collected. Yet, the receptacle must be accessible to the mail delivery person without keys or the necessity to open the locked compartment for delivery or pick up, and which can be understood and used readily by any delivery person without prior instructions.

SUMMARY OF INVENTION

In one aspect of the invention, a delivery receptacle has an upper compartment having a greater depth dimension than the lower compartment, with back walls of the upper and lower compartments being substantially aligned, such that the upper compartment has an extended front section with respect to a front wall of the lower compartment to permit a bricked-in installation of the receptacle.

BRIEF DESCRIPTION OF DRAWINGS

A more complete understanding of the invention and its advantages will be apparent from the Detailed Description taken in conjunction with the accompanying Drawings, in which.

DETAILED DESCRIPTION

All FIGURES in this patent are to scale. Substantially exact dimensions can be interpolated by one skilled in the art by noting that the length "L" of a standard postal mail box (FIG. 1) is about 20 inches.

Figure 1:
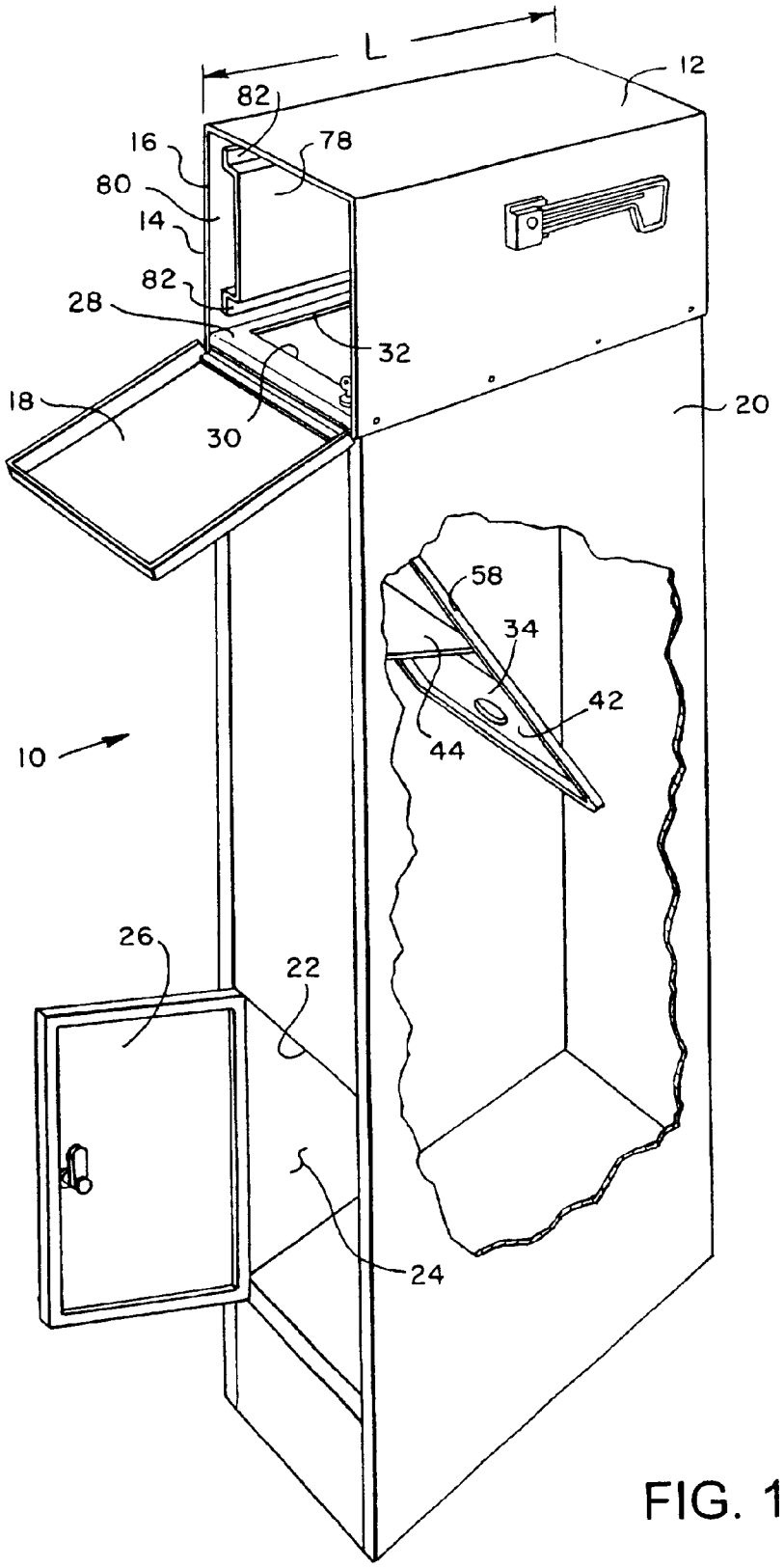
FIG. 1 is a front-top perspective view of an enhanced-security delivery receptacle.

Referring initially to FIG. 1, where like numerals indicate like and corresponding elements, receptacle 10 is an enhanced-delivery receptacle convertible between normal and high-volume configurations. Receptacle 10 includes an upper compartment 12 having a length "L" of about 31 inches. Edge 14 defines an upper compartment opening 16. Upper compartment opening 16 is selectively sealed by at least one upper compartment pivotable door 18.

Receptacle 10 also includes a lower compartment 20. Edge 22 defines a lower compartment opening 24 selectively sealed by at least one lower compartment pivotable door 26.

A divider wall 28 is located between the upper and lower compartments 12, 20. An edge 30 defines a divider wall opening 32, which is selectively sealed by an inner pivotable panel 34.

Figure 2:
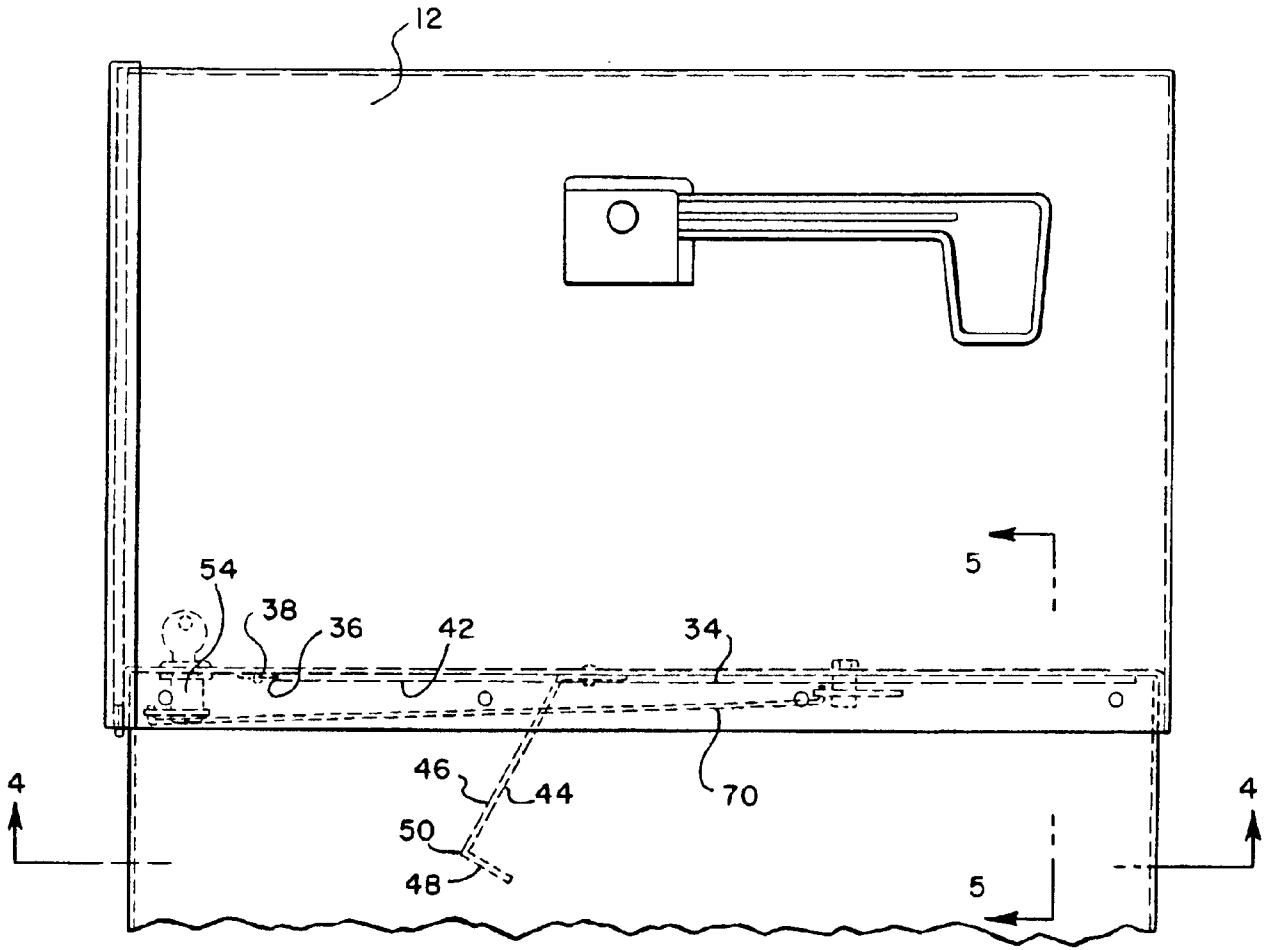
FIG. 2 is a side view of the top portion of the receptacle of FIG. 7.
Figure 3:
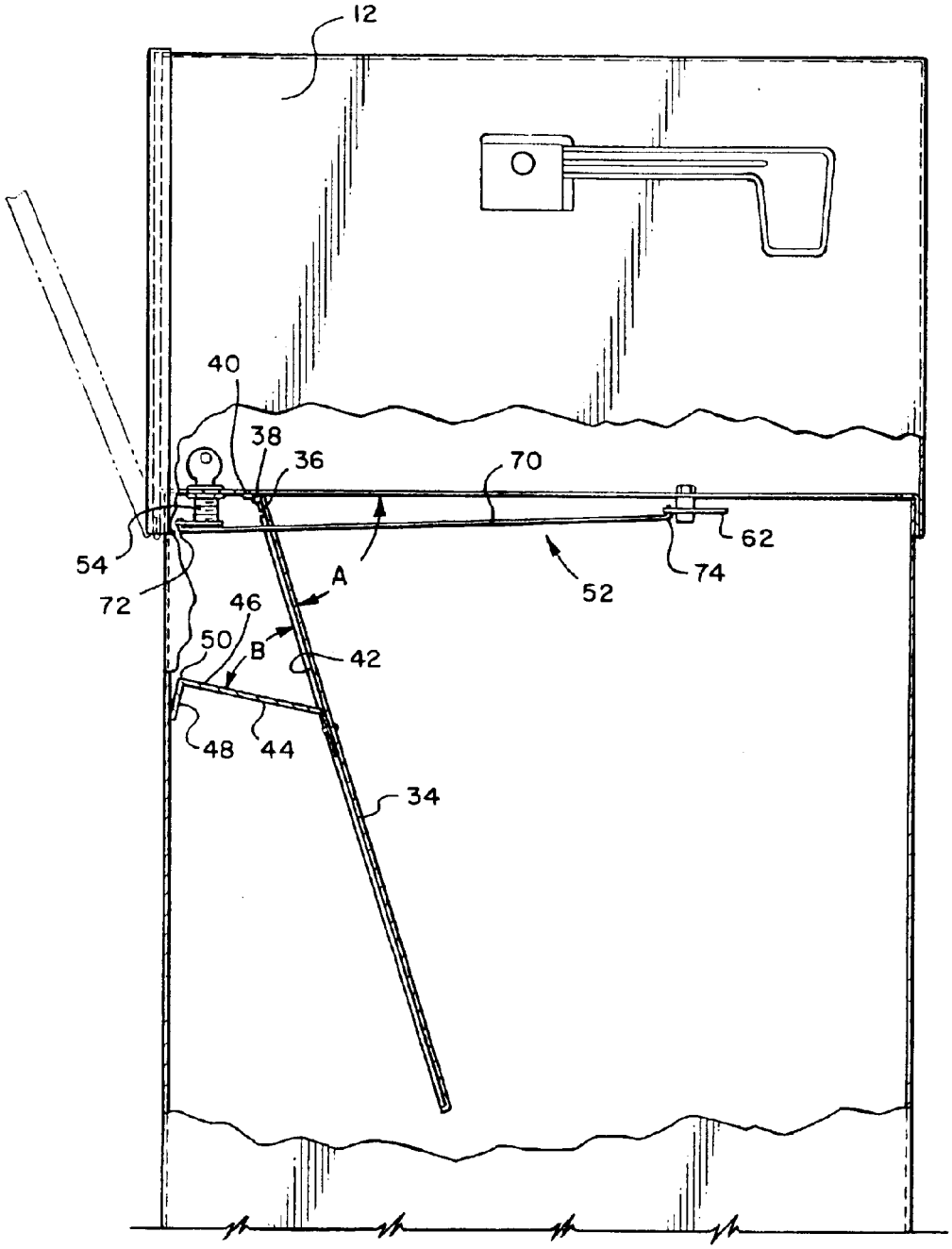
FIG. 3 is a partially broken away side view of the top and middle portions of the receptacle of FIG. 1.

A front edge 36 of the inner pivotable panel 34 is connected by a hinge 38 to a front edge 40 of the divider wall opening 32 for movement about the hinge 38 between selectable closed and open positions, FIGS. 2 and 3 respectively. The front edges 36, 40 of the inner pivotable panel 34 and the divider wall opening 32 are closely proximate to the upper compartment opening 16.

The inner pivotable panel 34 has a bottom surface 42. A stand-off member 44 is securely connected to the inner pivotable panel bottom surface 34. The stand-off member 44 is adapted and arranged to hold the inner pivotable panel 34 at an angle "A" (FIG. 3) with respect to the divider wall opening 32 when the inner pivotable panel 34 is in the open position, with the inner pivotable panel 34 sloping downwardly away from the upper compartment opening 16 when the inner pivotable panel 34 is in the open position. The angle "A" of the inner pivotable panel with respect to the divider wall opening when the inner pivotable panel is in the open position is in the range of about 60 degrees to about 80 degrees, and preferably about 75 degrees. It has been found that angles in this range are critical and optimal for enabling effective security without jamming.

The stand-off member 44 is composed of a planar member 46 disposed parallel to and spaced apart distance from the hinge 38. The planar member 46 spans substantially all the inner pivotable panel bottom surface 42. The planar member 46 has a planar foot 48 at a distal edge 50 with respect to the inner pivotable panel bottom surface 42. The planar member 46 is at an acute angle "B" (FIG. 3) with respect to the inner pivotable panel bottom surface 42.

Figure 4:
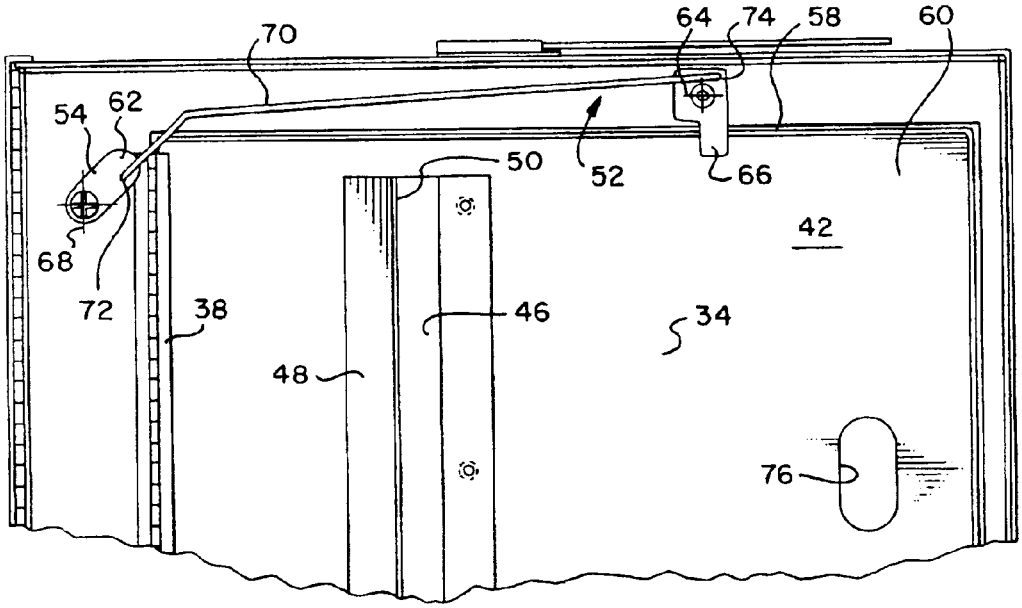
FIG. 4 is a partial sectional view taken along lines 4—4 of FIG. 1.
Figure 5:
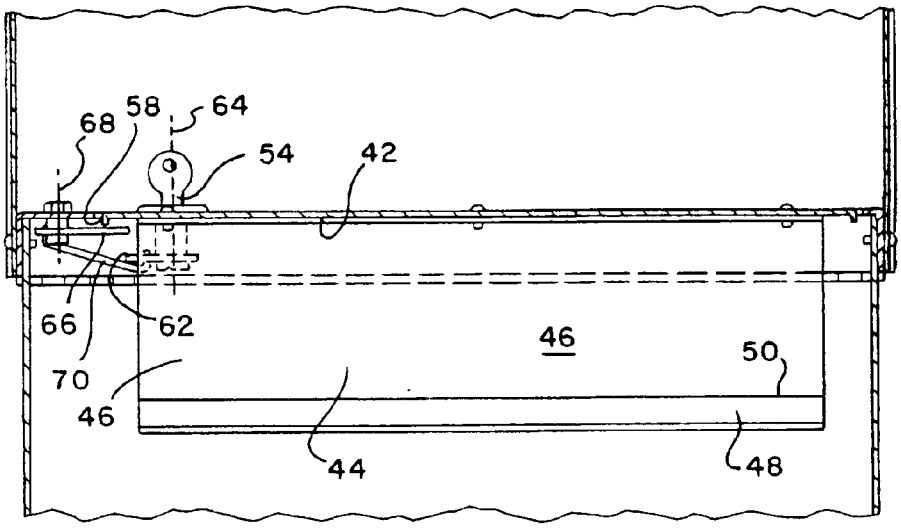
FIG. 5 is a partial sectional view taken along lines 5—5 of FIG. 1.

A mechanism 52 (FIGS. 3, 4) is provided for selectably holding the inner pivotable panel 34 in the closed position, as illustrated in FIGS. 2, 4, 5. A key feature of the invention is that the mechanism is operable from the upper compartment opening 16, such that the mechanism is out of sight and easily accessible by merely opening upper compartment pivotable door 18. Mechanism 52 is adapted and arranged to hold the inner pivotable panel 34 substantially flush with respect to the divider wall opening 32 when the inner pivotable panel 34 is in the closed position, and is actuatable to permit the inner pivotable panel 34 to slope downwardly away from the upper compartment opening 16 when the inner pivotable panel 34 is, in the open position. The mechanism 52 is preferably a key-locking mechanism, although this is not a necessary feature of the invention.

In one embodiment, mechanism 52 is entirely located within an interior space of the receptacle 10. An input member 54 is linked to an actuator 56 remote from the input member 54. The input member 54 is located in close proximity to the upper compartment opening 26, with the actuator 56 located in close proximity to a side edge 58 and a rearmost half 60 (FIG. 4) of the inner pivotable panel 34. The input member 54 is a finger 62 mounted for rotation about a vertical axis 64. The actuator 56 is a finger 66 mounted for rotation about a vertical axis 68. Link 70 has two ends 72, 74, with each end pivotally connected to one of the fingers 62, 66, such that rotation of the input member finger 62 causes rotation of the actuator finger 66 between engaged and disengaged positions. Actuator finger's engaged position is illustrated in FIGS. 2, 4, 5, and the disengaged position in FIGS. 1, 3. In the engaged position actuator finger 66 supports side edge 58 of inner pivotable panel 34. A hole 76 in inner pivotable panel 34 is provided to make it easy for the owner to convert the inner pivotable panel to its closed position.

An outgoing mail pocket 78 is formed on an inner side wall 80 of the upper compartment 12. Outgoing mail pocket 78 is preferably formed of bent sheet material having legs 82 fixed to the inner side wall 82.

In operation, receptacle 10 is an enhanced-security delivery receptacle that is convertible between normal and high-volume configurations. The upper compartment is sized such that it resembles and operates as a conventional post-mounted mailbox in the normal configuration. In the high-volume configuration, the inner pivotable panel slopes downwardly away from the upper compartment opening to permit mail and packages placed therein to fall into the lower compartment. Access to the lower compartment is provided through lower compartment pivotable door 26.

The integral, full-width stand-off member provides distributed and strong support for the inner pivotable member in its open position, yet is inexpensive and efficient to fabricate. In addition, the angle of the inner pivotable member is such that it would be difficult, though not impossible, for an unauthorized person to reach in and retrieve materials in the lower compartment. The essential feature of the receptacle is not complete security for items in the lower compartment, but rather enhanced security by the fact that it would be quite obvious to observant passers-by that an unauthorized person was attempting access to the lower compartment through the upper compartment.

The front-accessibility and complete enclosure of the mechanism for lowering the inner pivotable panel has several advantages. First, it is easy for the owner to convert from one configuration to the other and back by operation of the mechanism near the upper compartment door. No security device is effective in the long run if it is inconvenient for the owner to use. Second, it is not apparent from the exterior whether the receptacle is in its normal or high-volume configuration, a key feature to avoid tipping potential thieves and vandals to the owner's at home or away status. While the status could be readily ascertained by looking in the upper compartment, by definition thieves are lazy, and it is unlikely one would go to the effort of systematically checking a large number of receptacles on the chance that one might be found to be in high-volume configuration. Such systematic checking would be highly conspicuous as well, alerting observers that nefarious activity was underway.

Figure 6:
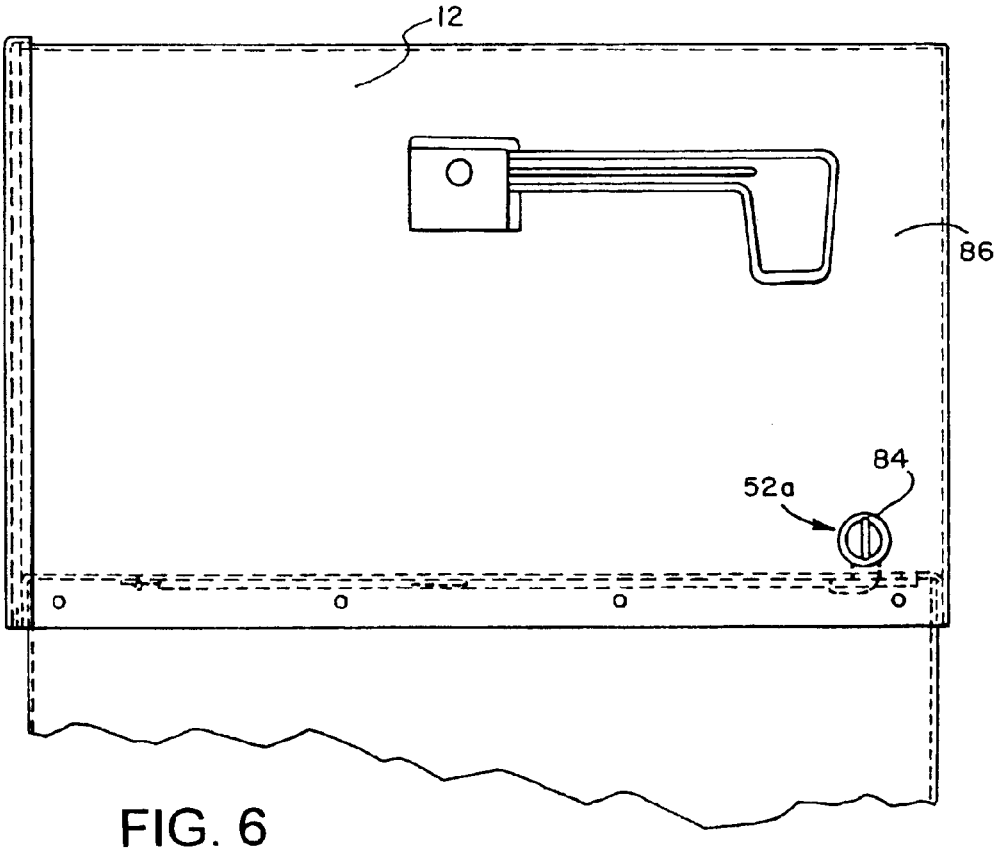
FIG. 6 is a side view of the top portion of a receptacle with an alternate locking mechanism.
Figure 7:
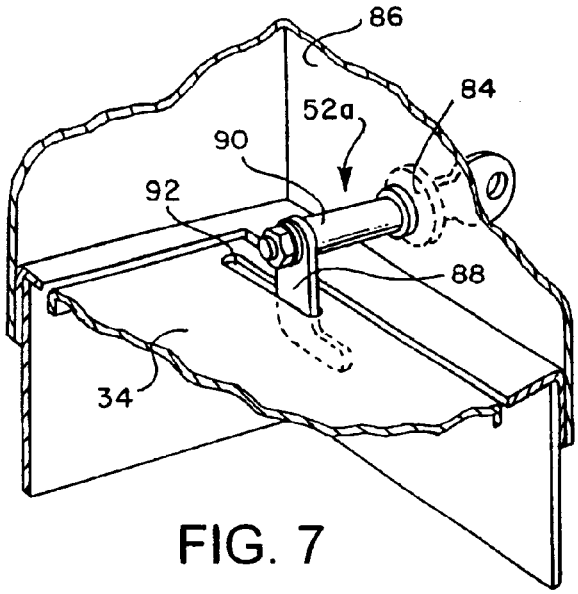
FIG. 7 is a partial perspective view of the locking mechanism of the receptacle of FIG. 6.

An alternate mechanism 52*a* for selectably holding the inner pivotable panel 34 in the closed position is illustrated in FIGS. 6 and 7. Mechanism 52*a* differs from mechanism 52 that is operable from the exterior of the upper compartment 12, which is advantageous from a cost of manufacturing standpoint but disadvantageous in other regards. As with mechanism 52, mechanism 52*a* is adapted and arranged to hold the inner pivotable panel 34 substantially flush with respect to the divider wall opening 32 when the inner pivotable panel 34 is in the closed position as shown in FIGS. 6 and 7. Inner pivotable panel 34 slopes downwardly away from the upper compartment opening 16 when the inner pivotable panel 34 is in the open position. Mechanism 52*a* includes a lock 84 fixed in side wall 86 of the upper compartment for pivoting movement. A finger 88 on an inner end 90 of the lock 84 is adapted for pivoting movement in response to rotation of the lock 84. A slot 92 in the inner pivotable panel 34 engages with the finger 88 to hold inner pivotable panel 34.

In operation, the alternate embodiment of FIGS. 6 and 7 offers many of the advantages of the previously described embodiment, except the mechanism for converting between configurations is only accessible from the exterior rear of the receptacle. This is less convenient for the user. An advantage, however, is that this embodiment is simpler and less expensive to manufacture.

Figure 8:
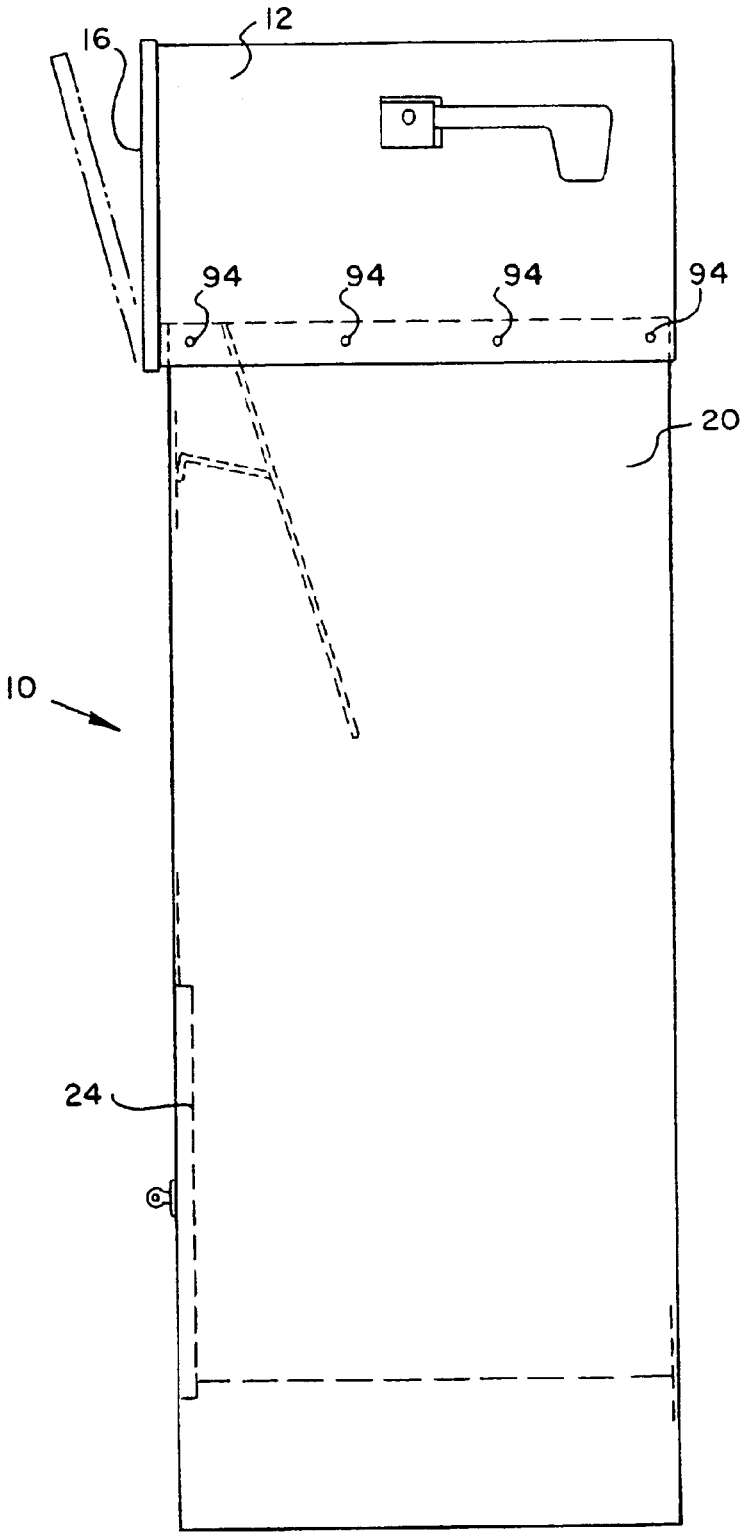
FIG. 8 is a side view of the receptacle of FIG. 1.
Figure 9:
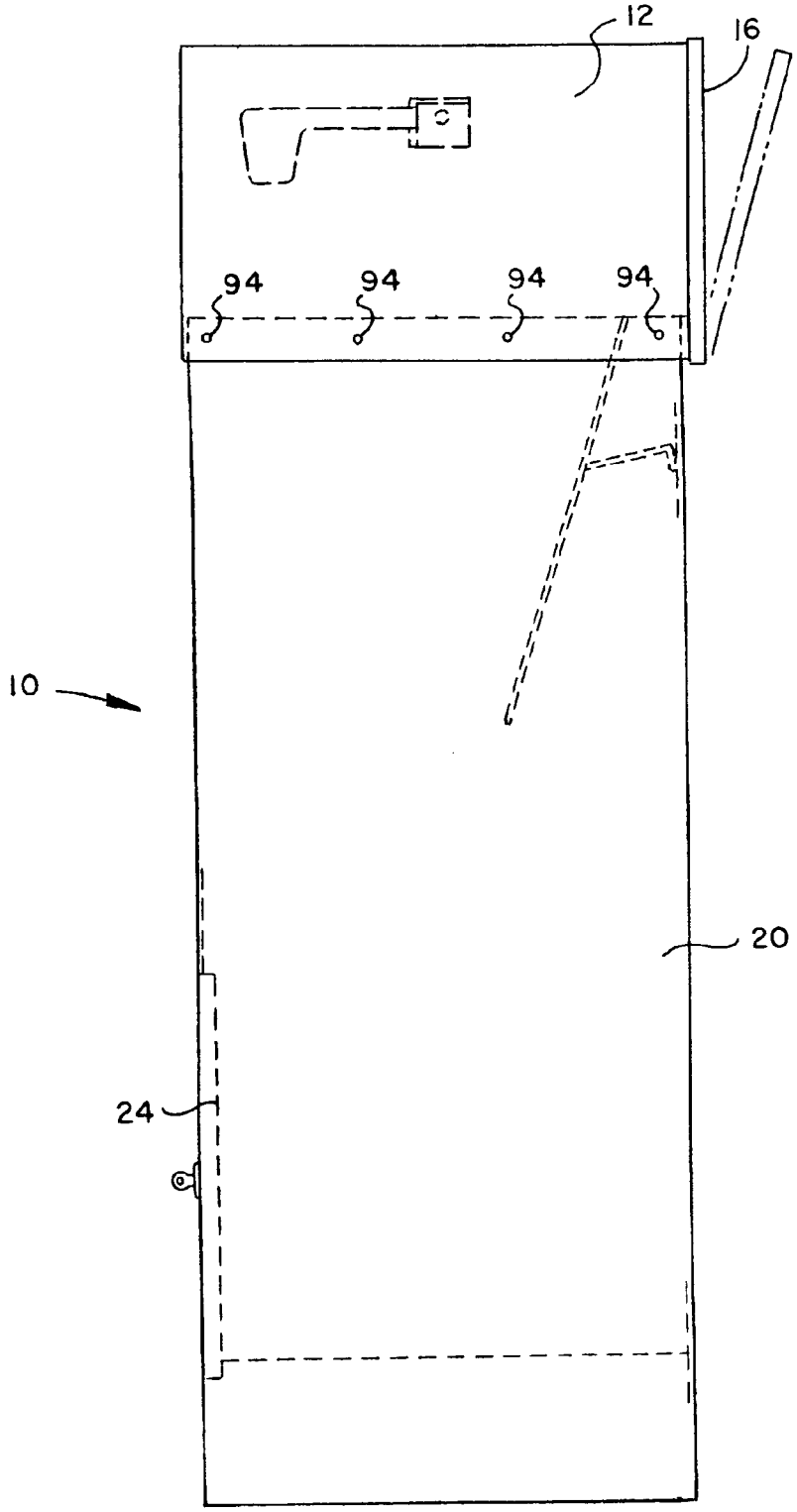
FIG. 9 is a side view of a receptacle similar to that of FIG. 1, but with the upper compartment facing the reverse direction.

In another embodiment, illustrated in FIGS. 8 and 9, an enhanced-security delivery receptacle has the upper and lower compartments 12, 20, being reversible in assembled orientation to each other, such that in a first assembled orientation (FIG. 8) the upper compartment and lower compartment openings 16, 24 face the same direction. In a second, reversed-assembled orientation (FIG. 9) the upper compartment and lower compartment openings 16, 24 face opposite directions. To enable the reversible orientations, lines of fasteners 94 are mirror image on the two sides of the receptacle 10.

In operation, this embodiment of the invention enables a choice of orientation by the user regarding the relative directions in which the upper and lower openings face. In some instances, for example, where the receptacle is built into a wall, it is essential that the openings face the same direction, as in FIG. 8. On the other hand, where the receptacle is placed free-standing along a roadside, it may be preferable to retrieve the contents from the side opposite the upper opening which faces the road, i.e., with the orientations reversed as in FIG. 9. It is advantageous for the maker of the receptacles to be able to adapt the product to a broader market by enabling the choice of orientations.

Figure 10:
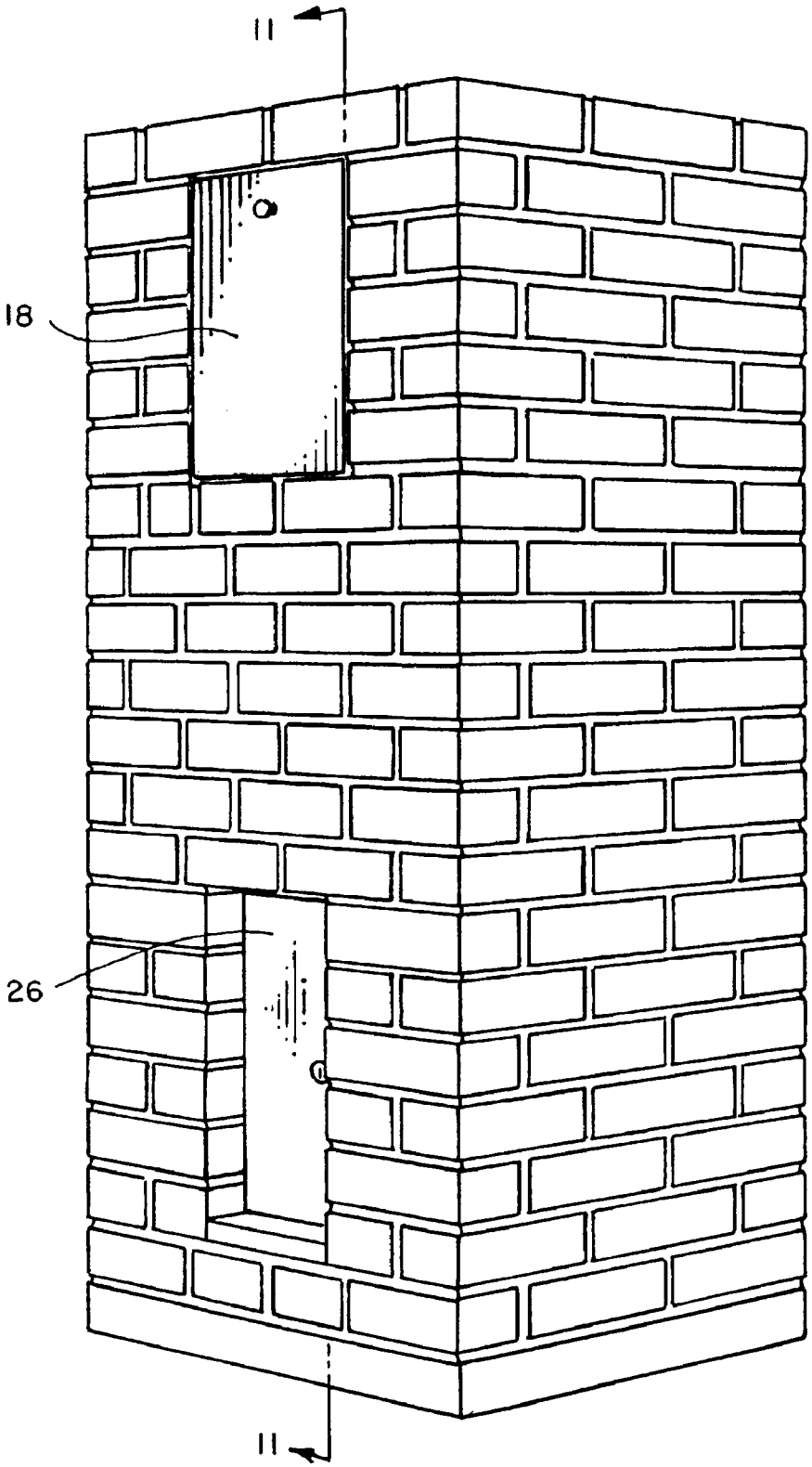
FIG. 10 perspective view of a receptacle encased in brick.
Figure 11:
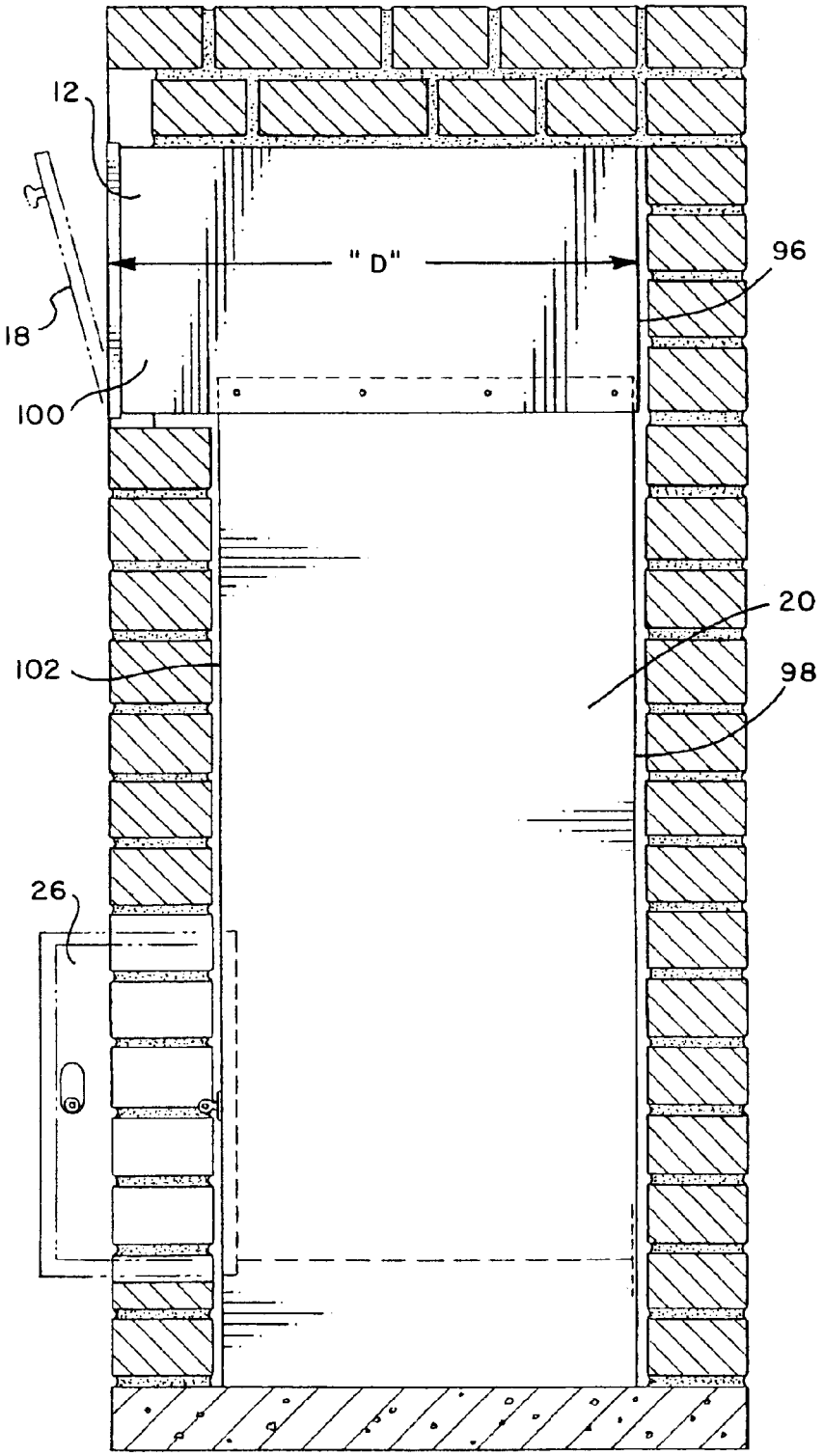
FIG. 11 is a sectional view taken along lines 11—11 of FIG. 10.
Figure 12:
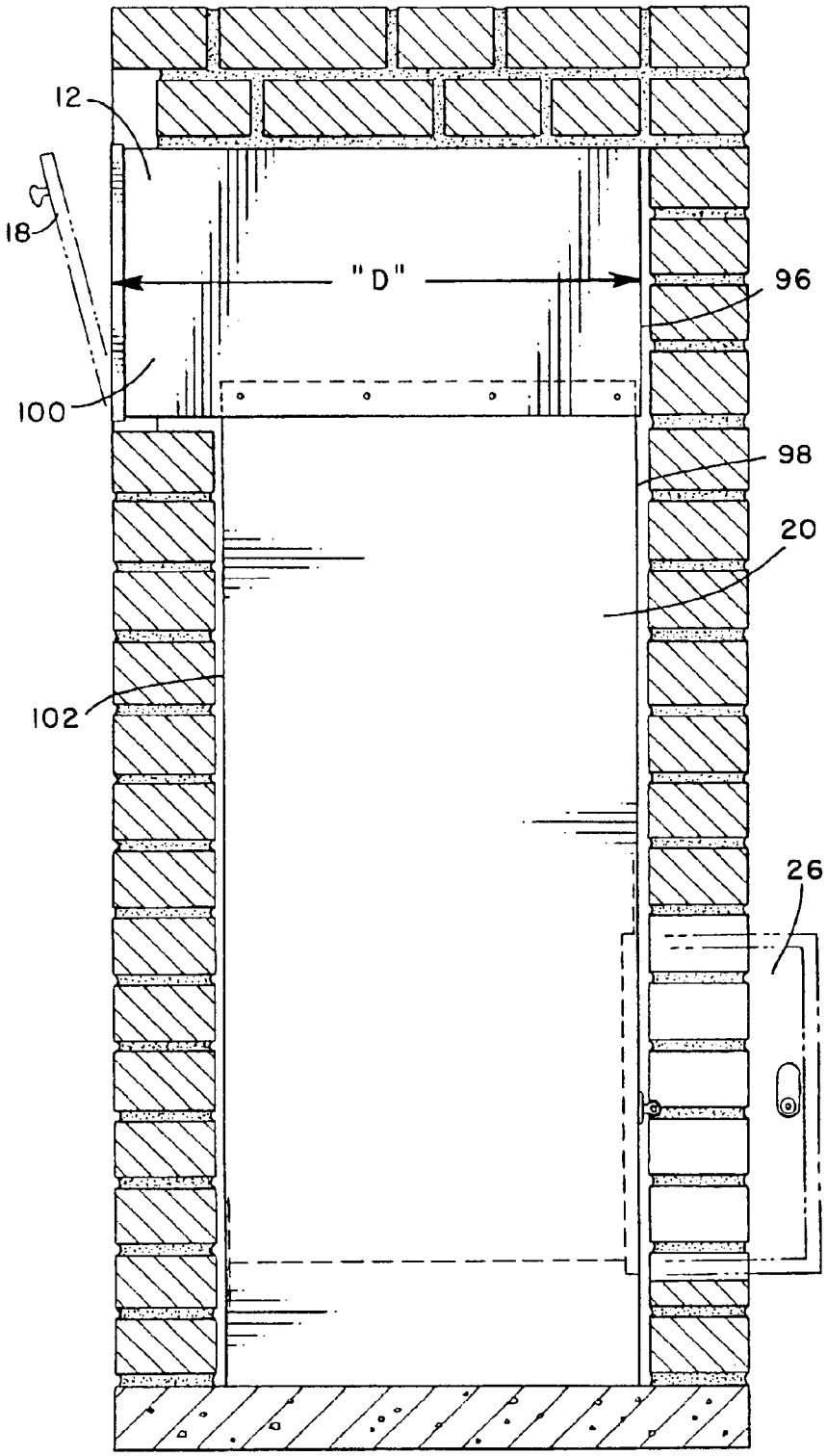
FIG. 12 is a partially broken away side view taken similar to FIG. 11, but with the upper compartment facing the reverse direction.

In yet another embodiment, as illustrated in FIGS. 10, 11 and 12, an enhanced-security receptacle is adapted for installation in a brick enclosure. The optimum configuration for a receptacle of this type is to have the upper compartment door hinged at the bottom edge for downward opening about a horizontal axis, as in conventional mail box, but the lower compartment door hinged at a side edge for swinging about a vertical axis. When the doors are in a same plane, as in FIG. 1, it is not possible to brick in the front without either blocking one of the doors or leaving the front face substantially exposed. In FIGS. 10, 11 and 12, enhanced-security delivery receptacle 10 has an upper compartment 12, upper compartment pivotable door 18, a lower compartment 20 and lower compartment pivotable door 26. A wall (not shown) between the upper and lower compartments 12, 20 is provided as in the prior embodiments. The difference is that the upper compartment 12 has a greater depth "D" dimension than the lower compartment. Back walls 96, 98 of the upper and lower compartments respectively are substantially aligned in the same plane, such that the upper compartment has an extended front section 100 with respect to a front wall 102 of the lower compartment 20 to permit a bricked-in installation of the receptacle.

As shown in FIGS. 11 and 12, in the brick-enclosable embodiment the upper and lower compartment doors can also either face the same directions or opposite directions. The upper and lower compartments are thus reversible in assembled orientation to each other, such that in the first assembled orientation the upper compartment and lower compartment openings face the same direction, and in the second, reversed-assembled orientation the upper compartment and lower compartment openings face opposite directions.

In a further embodiment of the invention, as shown in FIGS. 13–16, an enhanced security receptacle 150 is specially-adapted for receiving deliveries of packages and parcels. Receptacle 150 includes an upper compartment 152 with an upper compartment opening 154 selectively sealed by at least one upper compartment pivotable door 156. A lower compartment 158 has a lower compartment opening 160 selectively sealed by at least one, and preferably two, lower compartment pivotable doors 162, 164.

Figure 13:
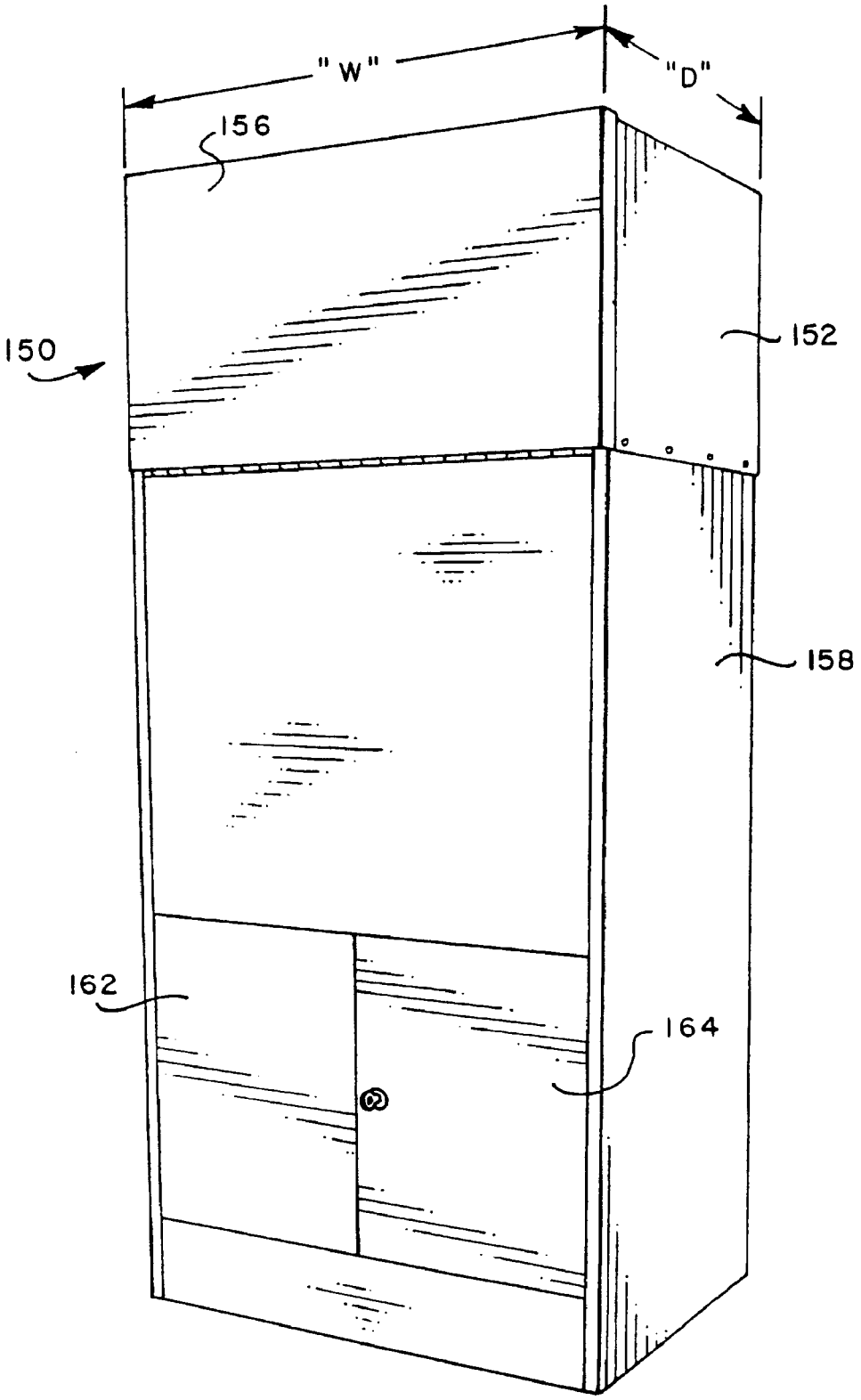
FIG. 13 is a perspective view of a receptacle specially adapted for packages.
Figure 14:
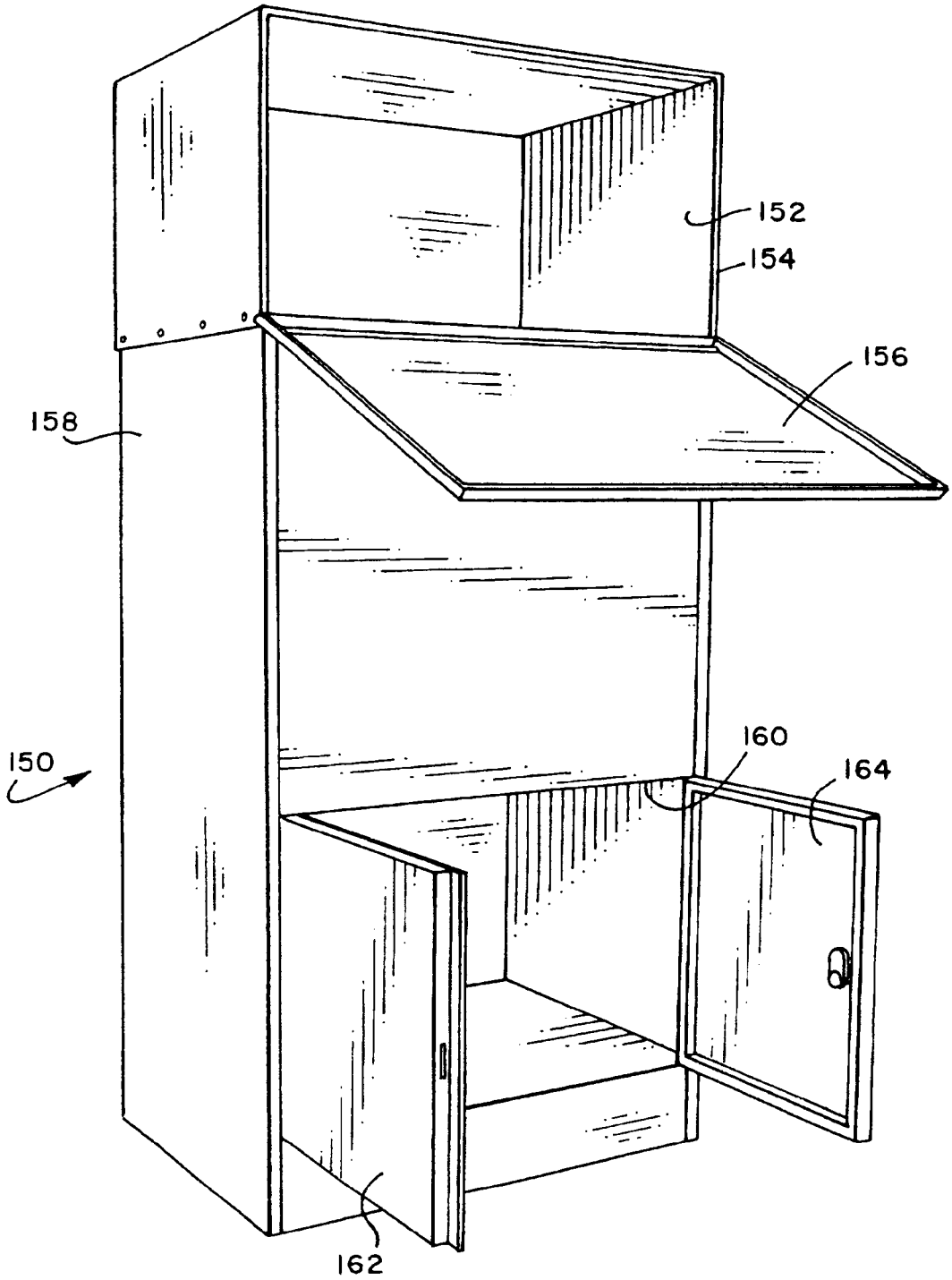
FIG. 14 is a perspective view of the receptacle of FIG. 13 with the doors open.
Figure 15:
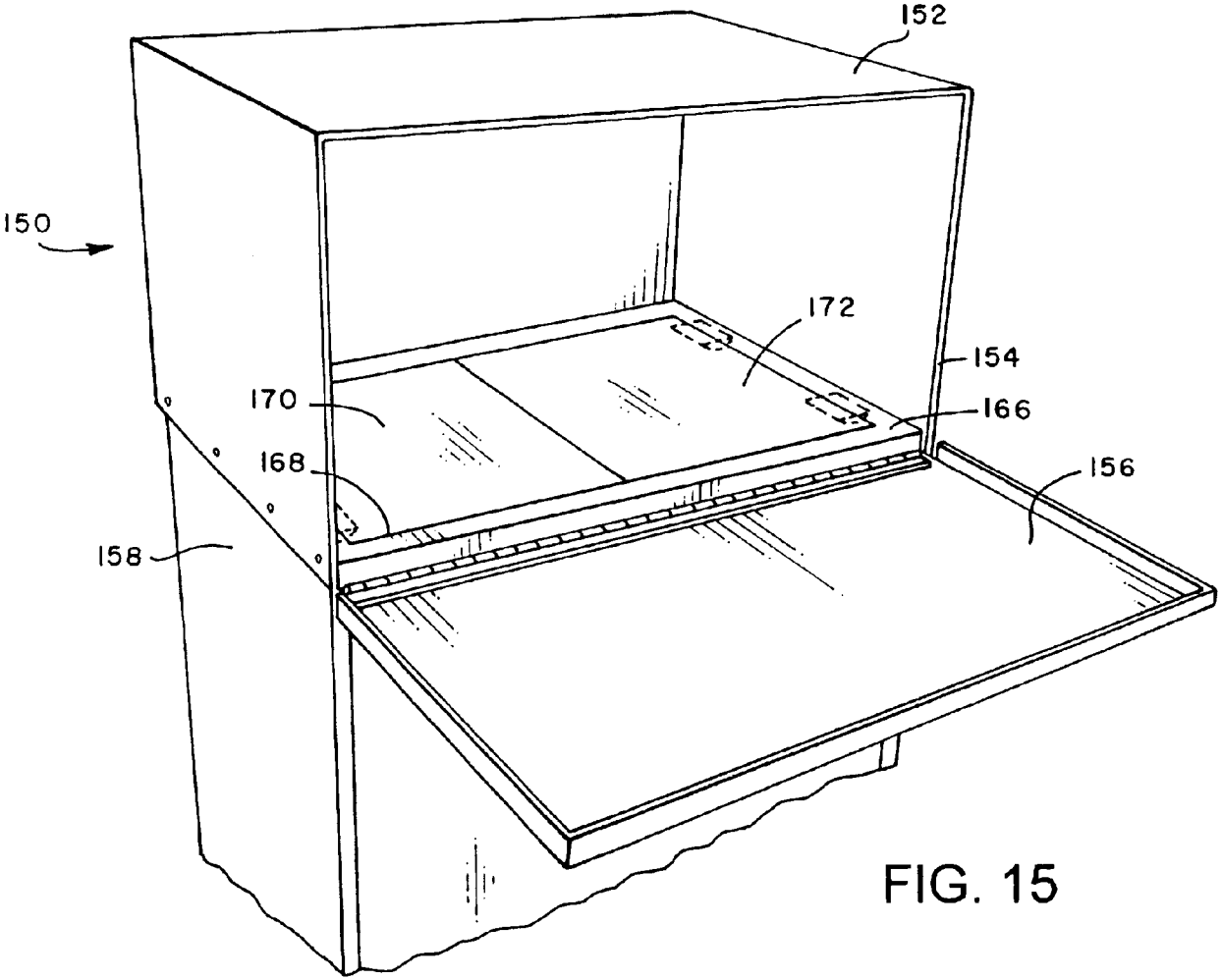
FIG. 15 is a perspective view of the upper compartment of the receptacle of FIG. 13.
Figure 16:
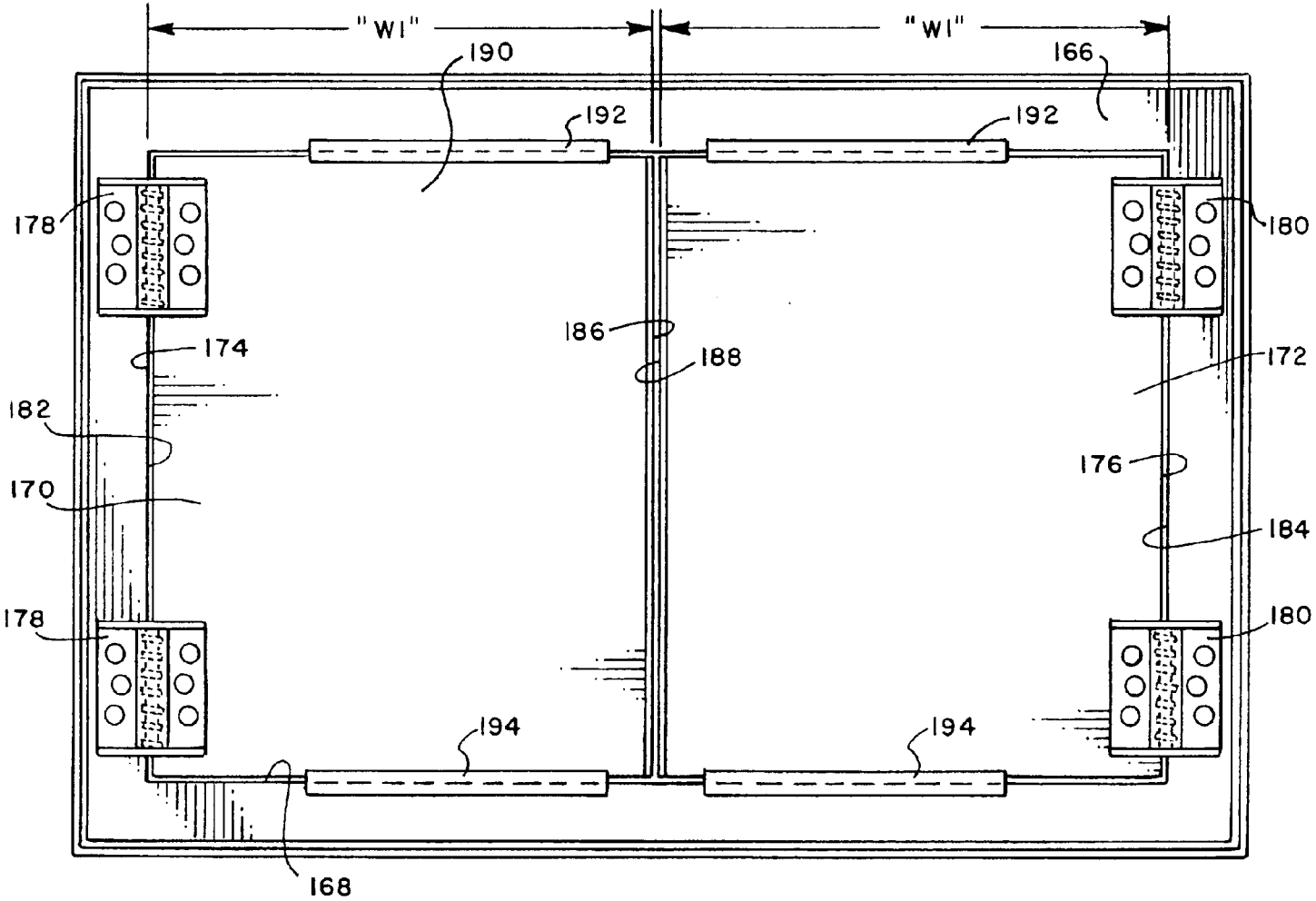
FIG. 16 is a partially broken away bottom view of the upper compartment of the receptacle of FIG. 13.

A divider wall 166 is provided between the upper and lower compartments 152, 154. A divider wall opening 168 is selectively sealed by two inner pivotable panels, 170, 172. In contrast to the embodiments described previously, the outer side edges 174, 176 of the inner pivotable panels 170, 172 are connected by spring-loaded hinges 178, 180 to side edges 182, 184 of the divider wall opening 168 for movement about the hinges 178, 180 between normally closed and forcibly-opened positions. Outer side edges 174, 176 of the inner pivotable panels and side edges 182, 184 of the divider wall opening are perpendicular to the upper compartment opening 154, such that the inner pivotable panels open downwardly and outwardly when forced open against the spring bias of the hinges. In order to optimally accommodate packages, receptacle 150 has a width dimension "W" on the order of twice its depth dimension "D" (FIG. 13). The inner pivotable panels 170, 172 have substantially equal width dimensions "W1" (FIG. 16), and their inner side edges 186, 188 substantially abut one another to form a substantially continuous bottom surface 190 of the upper compartment 152 when the inner pivotable panels 170, 172 are in their normally closed positions. Inner pivotable panels 170, 172 have front and back edge extensions 192, 194 to limit upward movement of the inner pivotable panels with respect to the divider wall opening.

In operation, the embodiment of FIGS. 13–16 is ideal for receiving parcels and packages when the owner is not home or does not wish to be disturbed by a delivery man. With "e-commerce" becoming a common mode of distributing products, common carrier (i.e., UPS, FedEx, etc.) delivery of parcels is almost a daily occurrence at some households. At present, when the recipient is not present to receive the parcel, the delivery man either has to come back for another attempt at a later time or leaves the parcel outside the door. With the present invention, the delivery is completed by pushing the parcel down through the spring-loaded inner pivotable panels 170, 172 from the upper compartment to the lower compartment, where the parcels are out of reach and sight until retrieved through the lockable lower doors 162, 164.

Figure 17:
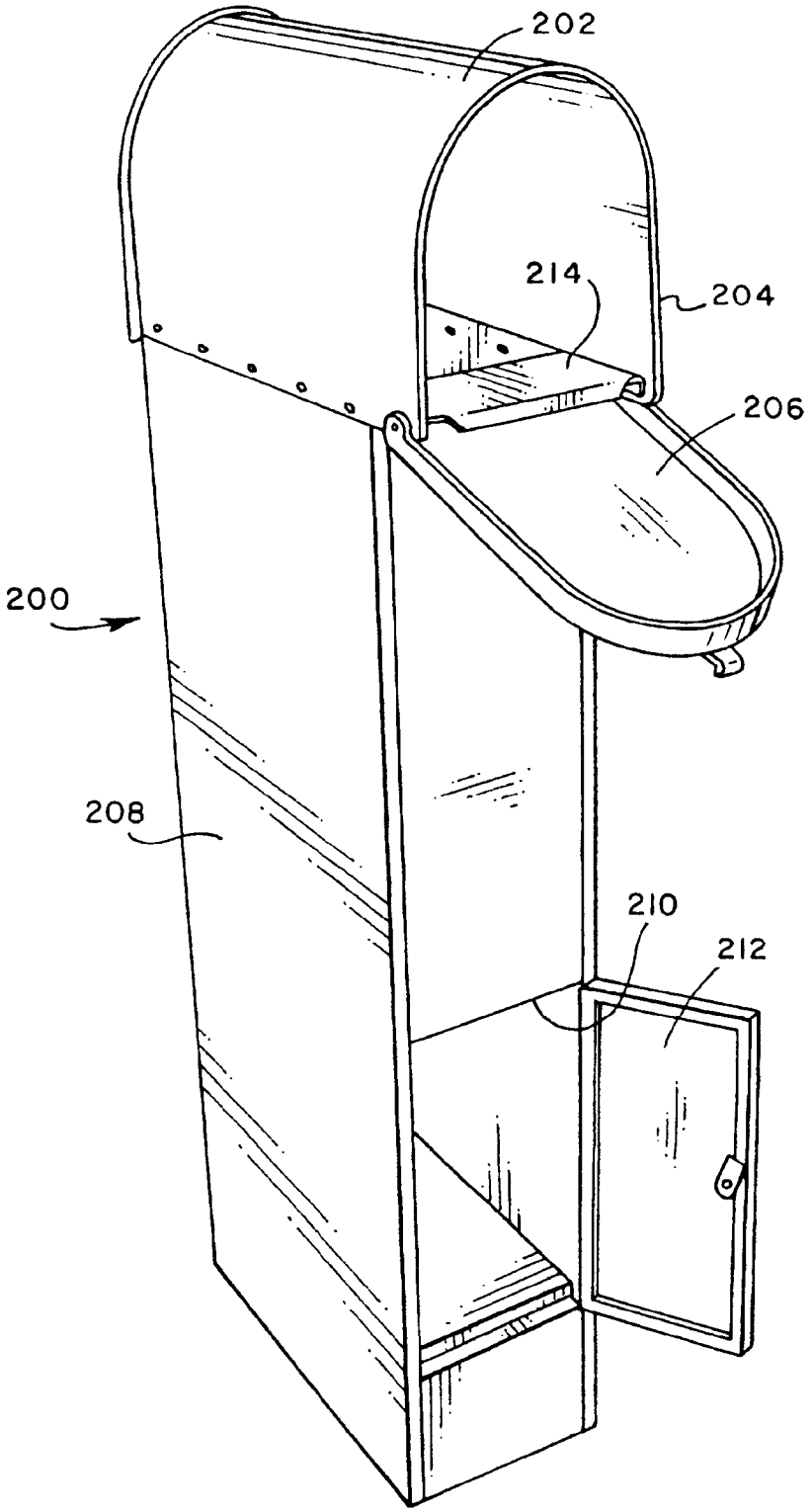
FIG. 17 is a perspective view of a receptacle having a permanently-fixed division between upper and lower compartments.
Figure 18:
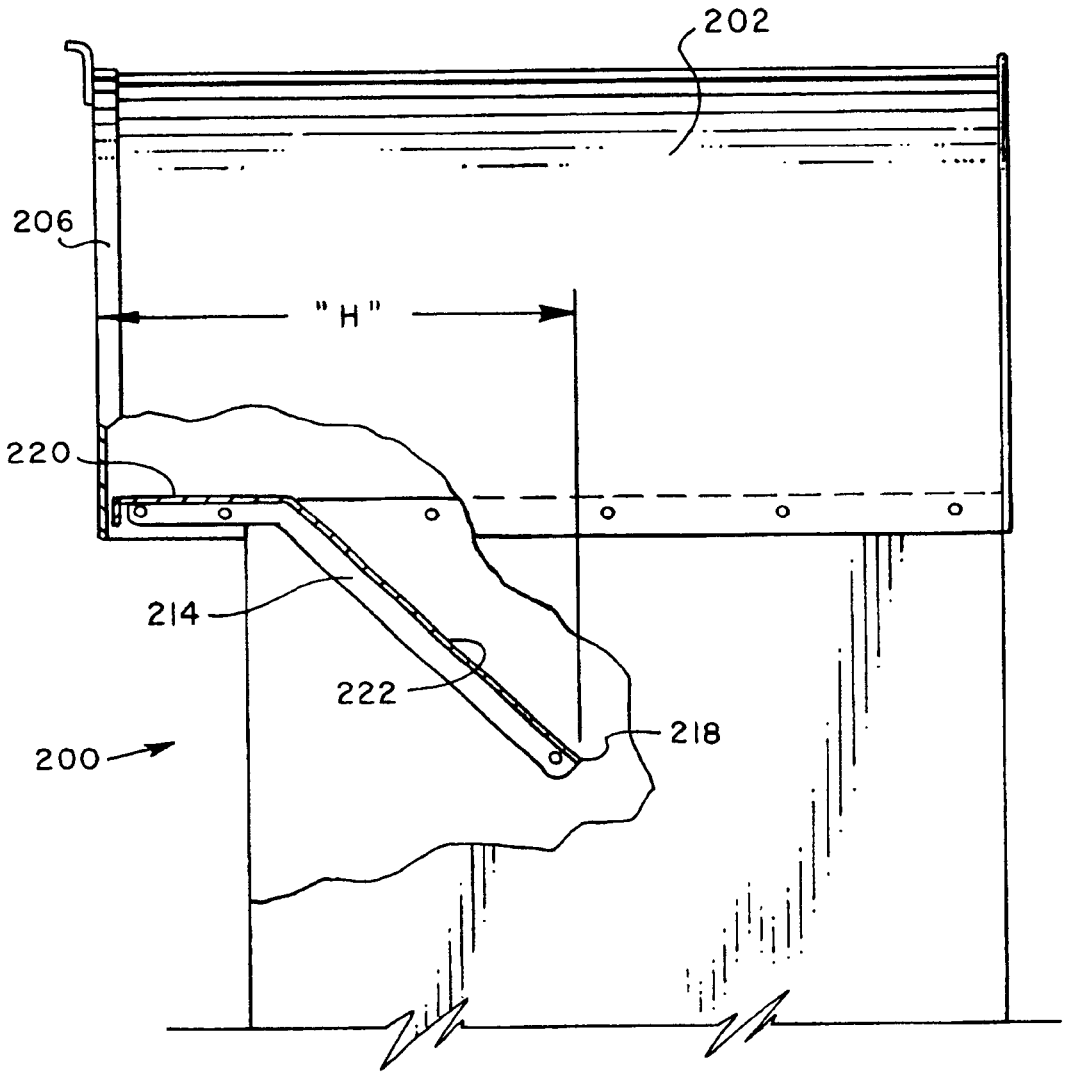
FIG. 18 is a partially broken away side view of the top and middle portions of the receptacle of FIG. 17.

Yet another embodiment of the invention is shown in FIGS. 17 and 18. An enhanced-security delivery receptacle 200 includes an upper compartment 202 and an upper compartment opening 204 selectively sealed by at least one upper compartment pivotable door 206. A lower compartment 208 has a lower compartment opening 210 selectively sealed by at least one lower compartment pivotable door 212.

A partial divider wall 214 is provided between the upper and lower compartments 202, 208, with a divider wall opening 218 between the upper and lower compartments. A key feature of the invention is that the divider wall 214 is fixed within the receptacle 200 and extends a horizontal distance "H" into the receptacle in the range of about 13 to about 17 inches. Divider wall 214 has a horizontal front section 220 and a downwardly sloping rear section 22, with the front section 220 being adjacent the upper compartment opening 204, and the rear section 222 extending into the lower compartment 208.

In operation, this embodiment of the invention has fewer features than those described above but is simpler and less expensive to purchase. All mail will collect in the lower compartment all the time, as the receptacle is not convertible. Outgoing mail can be placed on the front section 220. The key dimension "H" of 13 to 17 inches is sufficient to keep all but the most determined thieves or vandals from seeing or reaching mail collected below.

It will be understood that each of the elements described above, or two or more together, may also find a useful application in other types of constructions differing from the type described above.

While the invention has been illustrated and described as embodied in a braking systems, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

Whereas, the present invention has been described with respect to a specific embodiment thereof, it will be understood that various changes and modifications will be suggested to one skilled in the art and it is intended to encompass such changes and modifications as fall within the scope of the appended claims.

What is claimed as new and desired to be protected by Letters Patent is set forth the appended claims:

1. An enhanced-security delivery receptacle, comprising:

an upper compartment;

an upper compartment opening selectively scaled by at least one upper compartment pivotable door;

a lower compartment;

a lower compartment opening selectively sealed by at least one lower compartment pivotable door;

a divider wall between the upper and lower compartments;

a divider wall opening selectively scaled by an inner pivotable panel;

the divider wall forming a bottom wall of the upper compartment, with the lower compartment being open-topped;

the upper compartment having a greater depth dimension than the lower compartment, with back walls of the upper and lower compartments being substantially aligned, such that the upper compartment lies an extended front section with respect to a front wall of the lower compartment to permit a bricked-in installation of the receptacle; and the upper and lower compartments being separate and selectively reversible in assembled orientation to each other, such that in a first assembled orientation the upper compartment and lower compartment openings face the same direction, and in a second, reversed assembled orientation the upper compartment and lower compartment openings face opposite directions.

* * * * *